United States Patent [19]

Berlin

[11] Patent Number: 4,989,689

[45] Date of Patent: Feb. 5, 1991

[54] YARD GUARD

[76] Inventor: Evan H. Berlin, 10247 Dunn Ave., Lake City, Pa. 16423

[21] Appl. No.: 431,767

[22] Filed: Nov. 6, 1989

Related U.S. Application Data

[63] Continuation-in-part of Ser. No. 301,670, Jan. 26, 1989, abandoned.

[51] Int. Cl.[5] ..... E04H 17/14

[52] U.S. Cl. ..... 182/45; 182/113; 256/60; 256/24; 256/DIG. 6; 248/237

[58] Field of Search ..... 782/45, 113; 248/300, 248/237; 256/DIG. 6, 24, 60, 31, 73, 59

[56] References Cited

U.S. PATENT DOCUMENTS

| | | | |
|---|---|---|---|
| 2,545,347 | 3/1951 | Embree | 248/300 |
| 2,641,429 | 6/1953 | Kozak | 182/113 X |
| 3,880,405 | 4/1975 | Brueske | 182/113 X |
| 3,901,481 | 8/1975 | Bobst | 182/113 X |
| 3,936,087 | 2/1976 | Alexander | 248/99 X |
| 4,475,625 | 10/1984 | Clements | 182/113 |
| 4,685,656 | 8/1987 | Coe et al. | 256/24 X |
| 4,830,341 | 5/1989 | Arteau et al. | 256/DIG. 6 X |

FOREIGN PATENT DOCUMENTS

| | | | |
|---|---|---|---|
| 155341 | 6/1982 | Fed. Rep. of Germany | 182/113 |
| 760884 | 3/1934 | France | 182/113 |
| 91877 | 8/1968 | France | 182/113 |

*Primary Examiner*—Alvin C. Chin-Shue
*Attorney, Agent, or Firm*—Charles L. Lovercheck; Wayne L. Lovercheck

[57] ABSTRACT

A yard guard is disclosed which may be attached to a gable roof just above the eaves on a house that is to be re-shingled. The yard guard is a frame L-shaped in cross section with a guard rail to prevent old roofing material from falling from the roof onto shrubbery, grass and flowers to prevent damage and to save time in cleaning up.

1 Claim, 1 Drawing Sheet

YARD GUARD

REFERENCE TO PRIOR APPLICATIONS

This application is a continuation-in-part of application Ser. No. 301,670, filed Jan. 26, 1989, now abandoned.

BACKGROUND OF THE INVENTION

In the process of replacing roof coverings on gable roof building with roofs made of asphalt shingles or the like, the shingles are commonly allowed to slide down the roof onto the lawn, grass, shrubbery, and other plants, resulting in an unsightly appearance, damage to the plants and sometimes permanents damage to the grass and shrubbery, particularly in hot weather when the ambient heat burns the plants. Moreover, it is a time consuming laborious job in cleaning up the pieces of shingles, scraps of wood and the like.

STATEMENT OF THE INVENTION

Applicant has provided a yard guard, for protecting yards and lawns from roof parts, which is made up of guard sections which can be affixed to a roof just above the eaves. The guard can be made up of sections of a covenient length, for example, 6, 8, 10 or 12 feet in length. Each section can have a base plate to be nailed to the roof and an upwardly extending wall attached to one edge of the platform and enforcing gussets reinforcing the wall.

REFERENCE TO PRIOR ART

Previous snow shields have been attached to roofs to prevent snow from sliding from the roof to cause damage to the environment and to the roof itself. Applicant is aware of the following patents on snow guards:

| | |
|---|---|
| 472,014 to Densmore | 2,349,201 to Schweda |
| 1,085,474 to Peterson | 2,388,420 to Kott |
| 1,480,281 to Hacker | 3,617,691 to Toyooka et al |

These patents would not be suitable for use in removing roofs because they are intended to be permanently installed and they are not constructed to carry out applicant's purpose.

STATEMENT OF THE INVENTION

Applicant has provided a guard which can be attached to a roof during the re-roofing operation or roofing operation. The guard will stop shingles, parts of roofs, tools and the like from sliding from the roof.

The present yard guard not only provides a safety device but it also provides a portable yard guard that can be moved from job to job. The guard can be held in place by construction nails. Construction nails may be easily pulled out of the holes provided in the yard guard without damage to the yard guard or to the roof.

The yard guard can be made in eight foot lengths for convenience in carrying. Hand holes provide convenience in carrying the guard from job to job. The vertical and horizontal plates can be made of a suitable material, such as plywood, plastic or the like.

The yard guard herein disclosed provides a simple, efficient safety device and prevents loose material from sliding from a roof during the re-roofing operation of damage the surrounding environment.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
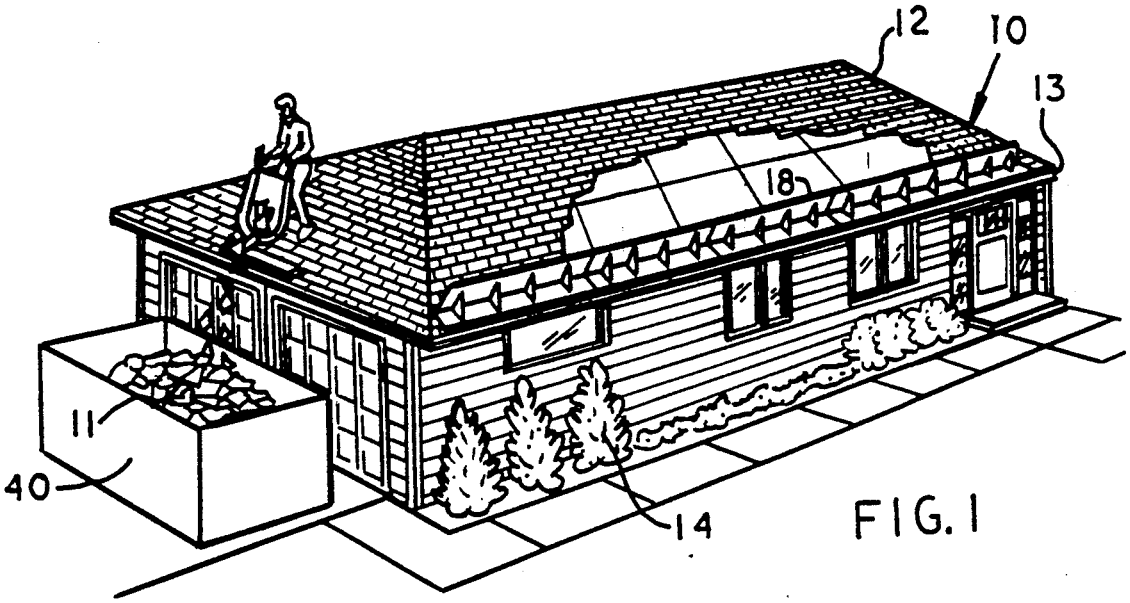
FIG. 1 is an isometric view of a gable roof building showing the guard according to the invention in place on a roof.
Figure 2:
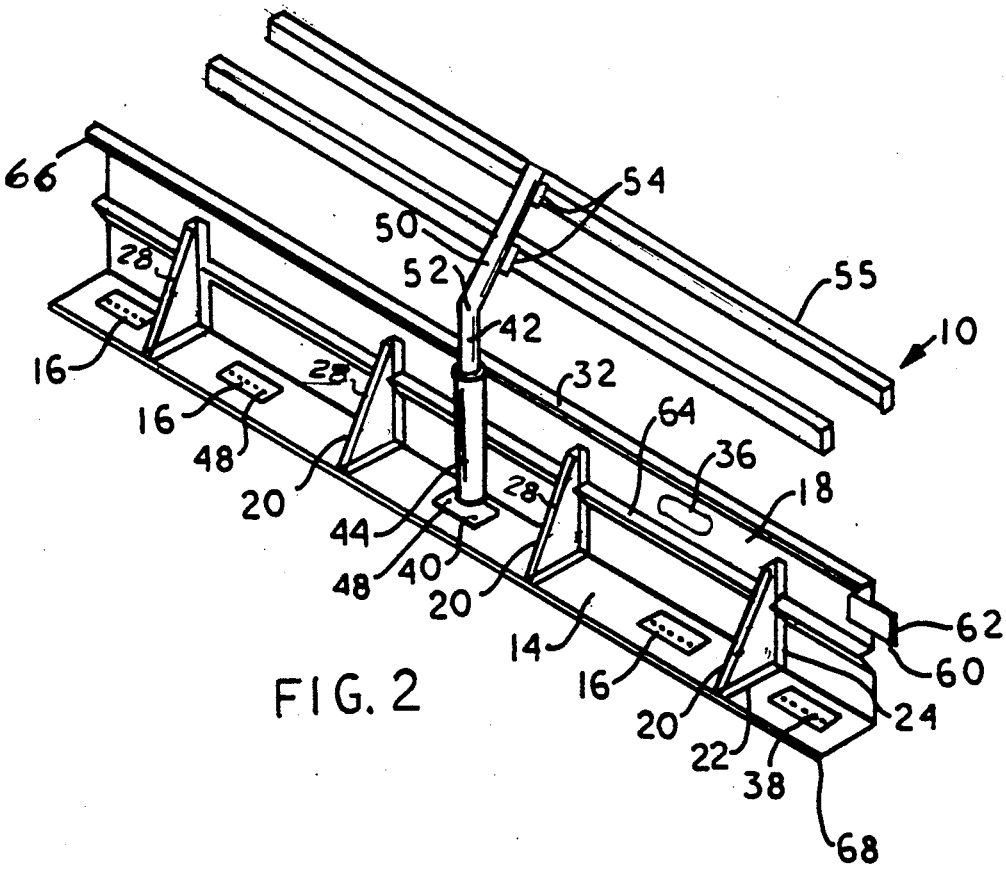
FIG. 2 is an enlarged isometric view of the yard guard shown in FIG. 1.

Now with more particular reference to the drawings, I show a yard guard 10 for use in re-roofing gabled roofed buildings having eaves with gutter 13 to prevent old roofing material from sliding off the roof onto the ground. Yard guard 10 is made of formed sheet metal, plastic or wood base plate 14, adapted to rest on roof 12. Spaced cleat plates 16 rest on base plate 14 to reinforce it. Vertical plate 18 is disposed generally perpendicular to base plate 14. When made of steel plate, the base plate 14 and vertical plate 16 may be made of a single sheet.

Spaced, generally triangular shaped gusset plates 20 have base 22, vertical side 24 and hypotenuse 28, and are fixed to base plate 14 at longitudinally spaced positions. Vertical side flange 24 of gusset plates 20 are fixed to vertical plates 18 at spaced positions whereby vertical plate 18 is held in rigid relation to base plate 14 so that loose material 11 that is pulled loose from roof 12 may slide down against vertical plate 18 and the loose material 11 is restricted from falling to the ground. Such loose material 11 can be deposited in a trash container 40. Moreover, vertical plate 18 provides a safety device for persons who may step on a piece of material and slide down roof 12, and be injured, particularly on roofs that have a steep pitch.

Nail holes 48 are provided in each cleat plate 16 and in base plate 14. Nail holes 48 are adapted to receive construction nail 38 or the like that may be placed through nail holes 48 and driven down into the sheeting of roof 12 to hold yard guard 10 in place.

Upper flange 32 is provided on vertical plate 18 by which the operator can grasp with his hand to carry yard guard 10 from place to place. Upper flange 32 may be bent downward at the upper end of vertical plate 18 to provide a finished edge and to prevent injury to the workmen who may rub against the upper edge of yard guard 10.

The embodiment of the invention shown has sockets 44 which may be sections of standard pipe, for example, two-inch schedule forty pipe or $2\frac{1}{8}$ inch OD tubing welded to a spaced cleat plate 16 which may be attached to the base plate 14 by welding or suitable fasteners. Columns 42 may be made of $1\frac{1}{2}$ inch standard pipe schedule fifty will be telesopically received in sockets 44. Upper part 50 of column 42 will be bent at an obtuse angle to lower part 52 so that upper part 50 will incline toward roof 12. Rail receiving channel shaped brackets 54 are angular, are welded to upper part and provide support for rail 55 which may be a $2\times4$ or the like.

Spaced cleat plates 16 are welded to the base plate 14 to form reinforcements for construction nails 38 which will be received in nail holes 48. Spaced plates 60 and 62 are welded to one end of vertical plate 18 to provide clips in which another yard guard 10, similar to the one shown, can be added to a first yard guard. Thus every yard guard will have two of spaced plates 60 and 62 welded thereto to receive an end of another yard guard to hold two yard guards in alignment.

Vertical plate 18 will have corrugations 64 formed therein for stiffness. Upper flange 32 will likewise add stiffness as will flange 66. Hand hold openings 36 are formed in vertical plate 18.

The foregoing specification sets forth the invention in its preferred, practical forms but the structure shown is capable of modification within a range of equivalent without departing from the invention which is to be understood is broadly novel as is commensurate with the appended claims.

The embodiments of the invention in which an exclusive property or privilege is claimed are defined as follows:

1. A yard guard for use on a building having a gable roof to prevent roofing material from sliding therefrom onto a yard during removal of said roof comprising, a base plate adapted to rest on top of a roof and means for attaching said base plate to said roof, a vertical plate disposed generally perpendicular to said base plate providing a barrier to stop said roofing material from falling, spaced generally triangular gusset plates, said gusset plates having a base, vertical side and a hypotenuse, said gusset plate having said base fixed to said base plate, said vertical side of said gusset plates being fixed to said vertical plate whereby said vertical plate is held in rigid relation to said base plate, nail holes in said base plate, each said nail hole adapted to receive a fastening means for fastening said yard guard to said roof, at least one socket fixed to said base plate, a column having an end received in said socked and extending upwardly therefrom, said column having vertically spaced rail receiving brackets thereon adapted to receive a generally horizontally disposed rail, said cloumn being made of an iron pipe, each said gusset plate having a base flange attached to said base plate and a vertical attached to said vertical plate, said column being removably attached to said yard guard, rail receiving brackets attached to said column, each said bracket being adapted to receive a rail generally rectangular in cross section, each said column having a first end received in a socket attached to said yard guard, said column being bent at an intermediate part whereby said rail is disposed in a plane with said vertical plate.

* * * * *